United States Patent [19]

Godley

[11] 4,187,030

[45] Feb. 5, 1980

[54] MIXER-AUGER MECHANISM FOR XEROGRAPHIC DEVELOPER COMPOSITIONS

[75] Inventor: William P. Godley, Sandy Hook, Conn.

[73] Assignee: Pitney-Bowes, Inc., Stamford, Conn.

[21] Appl. No.: 971,203

[22] Filed: Dec. 20, 1978

[51] Int. Cl.[2] ..... B01F 7/08

[52] U.S. Cl. ..... 366/319; 366/321; 366/324; 198/666

[58] Field of Search ..... 366/13, 81, 186, 133, 366/319, 321, 324, 155, 318; 198/660, 664, 666, 676; 355/3 DD; 118/2

[56] References Cited

U.S. PATENT DOCUMENTS

| | | | |
|---|---|---|---|
| 1,866,181 | 7/1932 | Turner | 198/666 |
| 2,492,915 | 12/1949 | Carlson | 198/666 |
| 3,130,070 | 4/1964 | Potters | 366/319 |
| 3,253,892 | 5/1966 | Brignac | 198/676 |
| 3,333,566 | 8/1967 | Kent | 118/2 |
| 3,639,051 | 2/1972 | Charlap | 355/3 DD |
| 3,705,644 | 12/1972 | Kawchitch | 198/664 |

*Primary Examiner*—Robert W. Jenkins

*Attorney, Agent, or Firm*—Martin D. Wittstein; William D. Soltow, Jr.; Albert W. Scribner

[57] ABSTRACT

An interlocking mixer-auger mechanism especially adapted to transport and mix developer compositions containing toner, or similar materials, prior to the feeding of such materials through an output port in the operation of a xerographic copying machine.

7 Claims, 7 Drawing Figures

FIG. 1
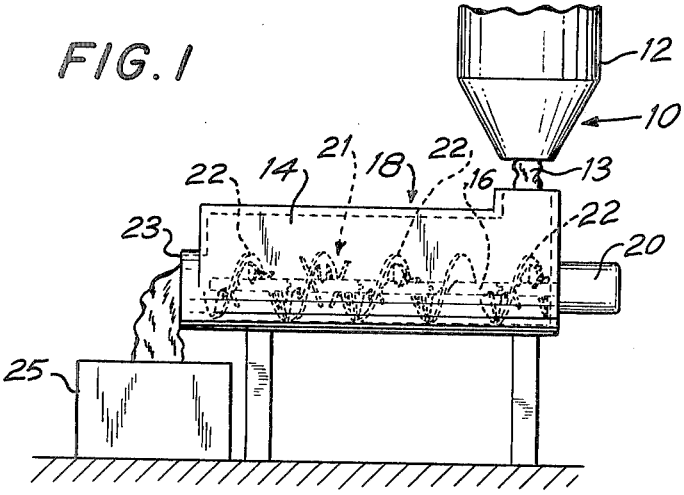
FIG. 2
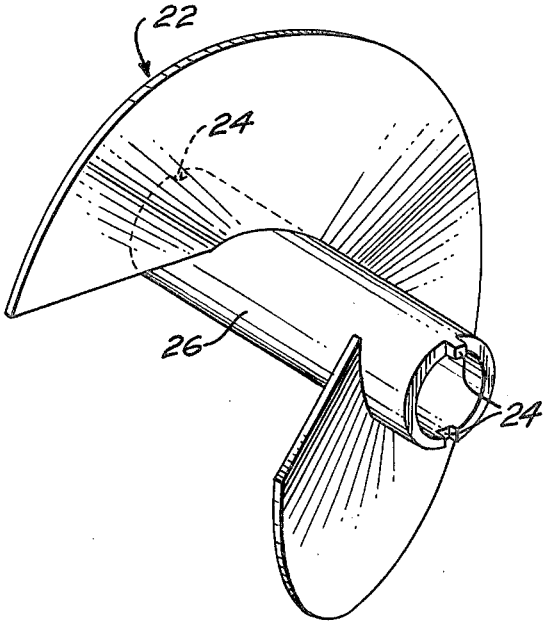
FIG. 3
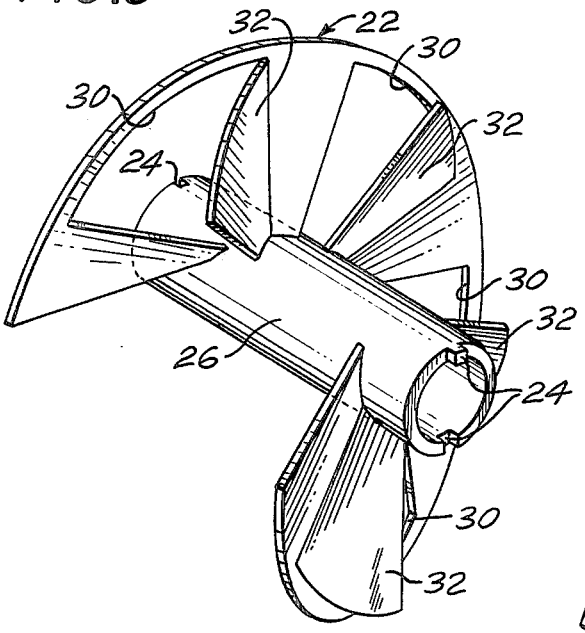
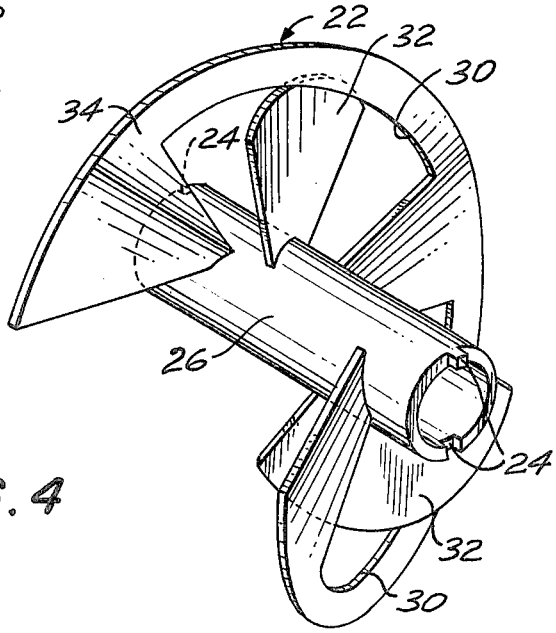
FIG. 4

MIXER-AUGER MECHANISM FOR XEROGRAPHIC DEVELOPER COMPOSITIONS

BACKGROUND, OBJECTS AND SUMMARY OF THE INVENTION

This invention relates to a mixing device and more particularly to such a device which is especially adapted to efficiently transport and to mix developer compositions including toner, or other similar materials, such as are conventionally used in present day xerographic or electrostatic copying machines.

It turns out that current manufacturing methods for producing mixing or auger mechanisms or devices useful for mixing toners and like materials are extremely costly principally because machining and other expensive techniques are employed in the manufacture of such devices.

Accordingly, it is a primary object of the present invention to avoid the costly and difficult conventional methods of producing toner mixing devices and instead to provide an inexpensive molded or diecast mixer-auger for such purposes.

In accord with the primary object noted, it is a feature of the present invention that the mixing device is formed by stacking or longitudinally mating individual fin elements or sections constituting the essential parts of the device. Each of the fin sections may include a hub as part of the individual sections such that they are then suitably adapted to be attached to an extended shaft member. Alternatively, the shaft itself may be defined by, or constituted of, individual shaft sections each of which is integral with a particular fin section.

It will be appreciated that a variety of devices for the mixing and conveying of grains or like materials has been known in the art. In order to provide some background for the present invention reference may be made to the following U.S. Pat. Nos.:

319,311 D. Peters
1,423,853 C. W. Hodgson
1,558,580 A. J. Bishop
1,795,792 P. W. G. Neilson Whatever the merits of the devices disclosed in the afore-cited patents, their disclosures do not reveal mixing devices which can be readily adapted to the purposes here intended, that is, to the mixing and conveying of developer compositions, containing magnetic carrier particles and toner particles, and like materials. This is because in the operation of xerographic copiers it is critically important to have the toner particles mix readily and uniformly with the magnetic or iron carrier particles. Otherwise poor copies will result in the copying process stemming from this lack of uniformity in the mixture. A further reason is that the charging triboelectrically of the toner mix must occur with a minimum amount of damage to the iron carrier or else fatigue effects will be produced. Another important reason for having a specially constructed mixing device for mixing developer compositions is so that a low torque load will be imposed, thereby to minimize shearing effects and the like in the actual mixing operation.

A number of systems or devices which are specifically intended for the purpose of mixing developer compositions have been proposed in the prior art; among such are those disclosed in U.S. Pat. Nos. 3,639,051 and 3,333,566, which may be referred to for background material.

A further primary object of the present invention is to enable efficient, gentle mixing of developer compositions which contain magnetic toner.

Another primary object of the present invention is to enable flexibility in the mixing and conveying of the developer compositions.

In the attainment of the primary or fundamental objects, a variety of configurations is provided for the aforenoted fin elements or sections such that a combination of functions of mixing and transport of material may be selected by the operator. In particular, the mixing aspect is efficiently accomplished by a specific configuration involving bypass action, by which is meant that a portion of the material that is being conveyed is allowed to fall back or to be bypassed through openings provided in the helical fin areas. Accordingly, the bypass function can be achieved by having a plurality of like elements assembled in a longitudinal array or end-to-end relationship, these elements being either affixed on a shaft or integrally defining such shaft; if desired, one or more of the bypass-configuration fin elements can be utilized with other fin configurations as will be explained in detail hereinafter.

Other and further objects, advantages and features of the present invention will be understood by reference to the following specification in conjunction with the annexed drawing, wherein like parts have been given like numbers.

BRIEF DESCRIPTION OF THE DRAWING

FIG. 1 is an elevational view of a complete mixing device, generally illustrating a longitudinal array of individual fin sections in accordance with a preferred embodiment of the present invention;

FIG. 2 is a perspective view of an individual helical fin section fashioned in accordance with a conventional helical screw configuration;

FIG. 3 is a perspective view of an alternate mode or version of a helical fin section;

FIG. 4 is another perspective view illustrating a third individual fin section in accordance with what is denominated the bypass mode;

DESCRIPTION OF PREFERRED EMBODIMENT

Figure 5:
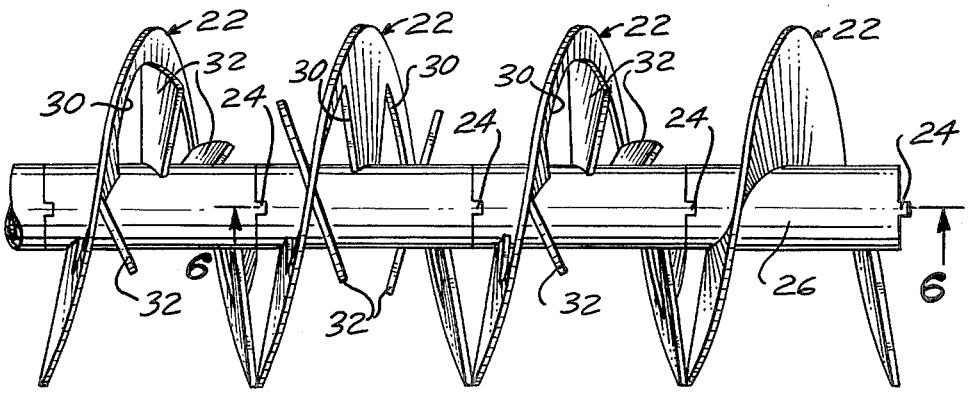
FIG. 5 is an elevational view of a particular combination of different helical fin sections, according to which the fin sections include hubs which are affixed to an extended shaft.

Referring for the moment to FIG. 1, there is illustrated a mixing device 10 in accordance with the present invention. Such a device includes a hopper 12 for the purpose of containing the initially mixed developer composition 13, the initial mix being unprecise as will be understood. There may be included within the hopper 12 suitable agitator blades or brushes so as to provide an initial break-up of the clumps which normally form in the developer composition. Below the hopper is a mixing chamber 14 and running therethrough, as will be seen, is an extended shaft 16 suitably journaled at the ends of the housing 18 forming the chamber. A suitable drive mechanism 20 is connected to a primary driving source, not seen. The operation of the drive mechanism 20 produces rotation of the shaft 16 so that, in accordance with the particular configuration selected for the mixer-auger mechanism 21, the composition 13 can be appropriately mixed while being transported to an output port 23, whence it passes to a bin 25 or similar apparatus shown schematically in FIG. 1.

Locked onto the shaft 16 are a number of individual sections 22 of helical blade or fin construction. These sections or elements 22 are of similar construction, each including a hub 26 integral with the fin or blade, and are adapted to fit together in a longitudinal array or end-to-end relationship as depicted. The sections 22 are tubular in construction, and typically can be made of plastic or metal. They have a pitch or thread-like design, either right or left hand, depending on the direction of travel desired.

Figure 7:
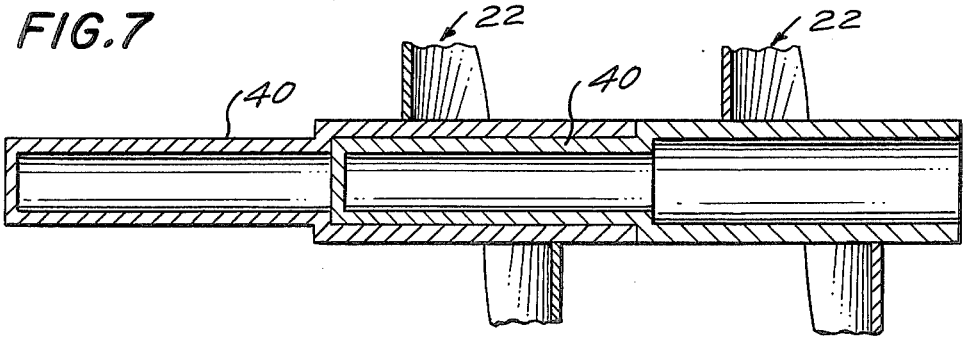
FIG. 7 is a sectional view of an alternate scheme or arrangement according to which the individual fin sections include specially constructed hubs which together make up or define the shaft member.

As especially seen in FIG. 5, a fitting or latching together of the individual sections 22 in a typical array is accomplished by a mating key and hole arrangement 24 formed as part of each section, and in opposite fashion at the respective ends. This arrangement is also seen in FIGS. 2, 3 and 4 which show the different individual fin configurations. It will be understood that at least one of the sections 22 in an array is suitably locked to the extended shaft 16 by means of a set screw or the like (not seen). However, as particularly illustrated in FIG. 7, instead of providing an extended shaft 16, the individual fin sections 22 can be formed as parts of the shaft, that is to say, the individual fin sections can include specially designed hubs 40 that fit together in end-to-end relationship so as to define a complete shaft.

The concept of the present invention which allows economic manufacture of a precision mixer-auger mechanism can be appreciated by reference to FIGS. 2 through 6 of the drawing. Therein is implemented the primary feature whereby rate of transport and mix can be variably controlled to allow integration of the transporting and mixing functions.

Where straightforward travel or transport is required, the conventional helical configuration of FIG. 2 is provided for section 22. However, where substantial mixing is desired with transport of the developer composition, the fin configuration of FIG. 3 is provided. In this mode or version, each fin section in a generally helical form is constructed to have a plurality of openings 30 spaced along the helical path. These openings, as can be seen, extend radially from the hub 26 outwardly to a point adjacent the peripheral edge of the helical turn defining fin section 22. They likewise extend circumferentially or peripherally so that the openings may be described generally as "sector openings". Extending angularly with respect to each of the openings, at the downstream side of the helical fin, is a projection or paddle 32 which significantly promotes the mixing function. It will thus be appreciated that the spaced sector openings 30 permit the "bypass action", by which is meant that a portion of the developer composition that is being conveyed longitudinally from, for example, right to left in FIG. 1, is permitted to fall back through openings 30. This materially assists in reducing the torque load on the shaft 16 as well as aiding in the mixing function.

Another mode or version of a fin section is illustrated in FIG. 4. Similar to the construction already seen in FIG. 3, the section 22 has a plurality of sector openings 30. Here, however, the objective is to accomplish the mixing by reverse feed, while transporting the developer composition in the appropriate direction. Thus, here the main fin or blade 34 provides the primary feed or travel, whereas the inner fins 32 which are seen to pass through the sector openings 30 and which are in a generally helical shape, have the opposite "hand" or direction from the primary fin or blade, so that they produce the reverse effect.

Figure 6:
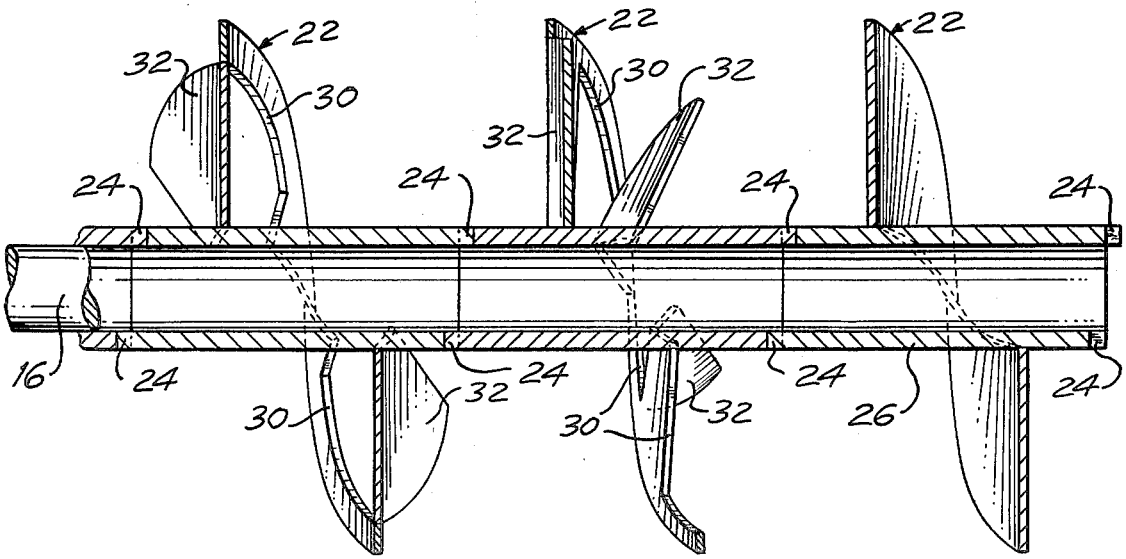
FIG. 6 is a sectional view of the combination seen in FIG. 5 taken on the line 6—6.

As will further be understood by the previous reference to FIGS. 5 and 6, a variety of combinations of desired functions can be accomplished by utilizing different ones of the fin constructions already seen in FIGS. 2, 3 and 4. Thus in FIG. 5, looking from left to right, a fin section of the construction according to FIG. 3 is first disposed on the shaft 16, followed by the primary-secondary fin construction of FIG. 4 for the next section 22. This is again followed on the right by another FIG. 3 fin section and finally, by the conventional fin section of FIG. 2. All of the sections 22 are designed to mate or fit together closely at their termination points. However, suitable gaps can be provided if desired.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. In a xerographic copying machine in which a toner developer composition is to be mixed and conveyed to a central point, the improvement in the means for mixing and conveying said toner, comprising:

a shaft;

a plurality of fin sections defining a helical conveyer structure, each fin section including a hub member having key means whereby said plurality of fin sections can be linked longitudinally with respect to said shaft, said fin sections having spaced bypass openings therein, and at least one of said sections having paddles or fins extending angularly from one side of said openings so as to produce thorough mixing of said toner and another of said fin sections including primary fins which are wound in a first helical direction and secondary fins which extend in a reverse helical direction through said bypass openings.

2. The improvement as defined in claim 1, in which said hub members constitute portions or sections of said shaft.

3. The improvement as defined in claim 1, in which said bypass openings are sector shaped and extend from the hub members to a point adjacent the peripheral edge of the individual fin sections.

4. The improvement as defined in claim 1, further including a housing for said helical conveyor structure, a hopper for containing developer composition, and further including means for feeding said developer composition to said housing.

5. The improvement as defined in claim 1, further comprising an outlet port for feeding said developer composition from said housing.

6. The improvement as defined in claim 1, further comprising drive means for turning said shaft.

7. The improvement as defined in claim 1, further comprising male and female key members on each end of said fin sections for linking said sections in a longitudinal array.

* * * * *